US006417868B1

(12) United States Patent
Bock et al.

(10) Patent No.: US 6,417,868 B1
(45) Date of Patent: Jul. 9, 2002

(54) SWITCHABLE DISPLAY DEVICES

(75) Inventors: Harald Reinhart Bock, Bordeaux (FR); Graham Andrew Cairns, Oxford (GB); Hirofumi Katsuse, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/389,132

(22) Filed: Sep. 2, 1999

(30) Foreign Application Priority Data

Sep. 3, 1998 (GB) ..... 9819071

(51) Int. Cl.[7] ..... G09G 5/10
(52) U.S. Cl. ..... 345/698
(58) Field of Search ..... 345/84, 87–89, 345/103, 690, 694, 695, 696, 698

(56) References Cited

U.S. PATENT DOCUMENTS 5,905,482 A * 5/1999 Hughes et al. ..... 345/89
6,016,133 A * 1/2000 Nito et al. ..... 345/89
6,094,187 A * 7/2000 Jones et al. ..... 345/147
6,094,249 A * 7/2000 Robinson et al. ..... 349/141
6,271,820 B1 * 8/2001 Block et al. ..... 345/97

FOREIGN PATENT DOCUMENTS

EP 673011 A1 3/1995
EP 673012 A2 3/1995
EP 810587 A1 12/1996

OTHER PUBLICATIONS

Search Report for British Patent Application No. 9819071.3 dated Nov. 19, 1998.

* cited by examiner

*Primary Examiner*—Michael Razavi
*Assistant Examiner*—G. F. Cunningham
(74) *Attorney, Agent, or Firm*—Renner, Otto, Boisselle & Sklar

(57) ABSTRACT

A display device comprising a plurality of picture elements arranged in rows and columns, each picture element being switchable between at least two states having different optical output characteristics, a plurality of row and column drivers, connected to said rows and columns respectively, for switching said picture elements between said states, wherein at least one switch is provided for switching at least one of said drivers between a first configuration in which the driver drives at least one row or column, and a second configuration, different from said first configuration, in which the driver drives at least two rows or columns.

29 Claims, 3 Drawing Sheets

SWITCHABLE DISPLAY DEVICES

TECHNICAL FIELD OF THE INVENTION

The invention relates to switchable display devices, and particularly, although not exclusively, to switchable liquid crystal display devices using spatial dither (ie. pixel subdivision) to achieve different grey levels. Embodiments of the invention allow a display panel to be operated at different resolutions, while maintaining an optimum number of spatial dither grey levels in the lower resolution, without increasing the number of drivers required.

BACKGROUND OF THE INVENTION

Some prior art documents will first be discussed.

"New bistable liquid-crystal twist cell"—D. W. Berreman and W. R. Heffner; J. Appl. Phys. 1981, 52 (4), 3032—describes the Bistable Twisted Nematic (BTN) effect, where selection between two metastable states (strong twist, e.g. 360 degrees, and weak twist, e.g. 0 degrees) is achieved by reducing a voltage either abruptly or gradually after blanking to the homeotropic weak state. This effect has the disadvantage of not giving grey level control.

European Patent Publication No.0613116 describes addressing with very short address times by placing the short selection pulse at an optimised position in time after the blanking pulse (so there is a pause between the two). Two modes of addressing are described as very high and very low selection voltage pulses both generate the highly twisted state (black in thin cells between crossed polarisers) whereas intermediate pulse voltages generate the low twist (white) state. This patent is important for fast BTN addressing as required for high resolution passive video displays. It has the disadvantage of not giving grey level control. "A Bistable Twisted Nematic (BTN) LCD Driven by a passive Matrix Addressing"—-T. Tanaka, Y. Sato, A. Inoue, Y. Momose, H. Nomura, S. Iino; Proceedings of Asia Display '95, 259—presents a first black and white BTN panel. The pixels of this panel are not capable of displaying intermediate grey levels.

The use of the BTN effect as described in the prior art does not allow the generation of intermediate grey levels within the pixel.

The following publications relate generally to bistable LC effects and provide background information:

G. D. Boyd, J. Cheng and P. D. T. Ngo, Appl. Phys. Lett. 36, 556 (1979)

N. A. Clark and S. T. Lagerwall, Appl. Phys. Lett. 36, 899 (1980)

R. Barberi, M. Boix and G. Durand, Appl. Phys. Lett. 55, 2506 (1989)

Barberi and G. Durand, Liquid Crystals 10, 289 (1991) R. Barberi, M. Giocondo and G. Durand, Appl. Phys. Lett. 60, 1085 (1992)

M. Pfeiffer et al., SID 95 Digest, 706

W. Hartmann, Ferroelectrics 122, 1 (1991) discusses grey scale techniques for FLCs.

R. A. Martin et al. Journal of the SID 4/2, 1996 p65 describes an active matrix display used as a binary mode. In this case greyscale is achieved by an error diffusion technique, the display does not have two separate resolution modes.

In matrix displays, greyscale can either be achieved within the pixel element, if the used effect offers an analogue or other range of configurations of different brightness, or by subdividing the pixel temporally or spatially if the effect offers only a black and a white state (or a limited number of states).m This invention is concerned principally with spatial subdivision of pixels into subpixels (spatial dither). The more subpixels you have, the more column (data) and row (strobe, select) drivers you normally need, and the cost of the display increases. It is often advantageous (and common practice in cathode ray tube (CRT) monitors) to have the choice between different screen resolutions. If such different resolutions are achieved in spatial dither panels, where a higher resolution with less greyscale and a lower resolution with more greys are offered, the optimal patterning of the subpixels is different for the two resolutions. To achieve both patterns the display has to be subdivided into more subpixels than will ever be addressed independently at one time. More subcolumns and/or subrows exist than are addressed independently, and therefore several drivers are used identically.

SUMMARY OF THE INVENTION

According to the invention there is provided a display device comprising a plurality of picture elements arranged in rows and columns, each picture element being switchable between at least two states having different optical output characteristics, a plurality of row and column drivers, connected to said rows and columns respectively, for switching said picture elements between said states, wherein at least one switch is provided for switching at least one of said drivers between a first configuration in which the driver drives at least one row or column, and a second configuration, different from said first configuration, in which the driver drives at least two rows or columns.

The invention thus reduces the number, and therefore the manufacturing cost, of the drivers.

Each picture element may be switchable between only two states.

Said two states may correspond to the picture element being on and off.

In one embodiment of the invention, at least some picture elements emit or transmit light at a different wavelength to other picture elements.

In this case, some of said picture elements may emit or transmit red light, some emit or transmit green light, and some emit or transmit blue light.

In a further embodiment of the invention, said one switch is a row switch which switches at least one of said row drivers between said first and second configurations, and the display device also comprises at least one column switch for switching at least one of said column drivers between a third configuration in which the column driver drives at least one column, and a fourth configuration, different from said third configuration, in which the column driver drives at least two columns.

In a further embodiment of the invention, operation of said switch or switches allows the display device to operate in at least two resolutions, including a high resolution mode and a low resolution mode In a further embodiment of the invention, the number of grey levels in the low resolution mode is higher than would be possible without said switch or switches, for a device also capable of operating in said high resolution mode.

In a further embodiment of the invention, said picture elements are arranged in an array of identical groups of picture elements, each group being formed by picture elements at the intersection of number of adjacent rows and columns of picture elements, and each group containing picture elements of different sizes.

Each such group of picture elements may be connected to an identical switch or set of switches.

The display device may be formed from a liquid crystal panel.

The liquid crystal panel may form a passively addressed array.

The display device may be a bistable liquid crystal display device for example a bistable twisted nematic liquid crystal display or ferroelectric liquid crystal diplay.

The invention allows operation of a panel in at least two different resolutions with optimised numbers of grey levels and a minimised number of line drivers.

BRIEF DESCRIPTION OF THE DRAWINGS

Embodiments of the invention will now be more particularly described, by way of example only, with reference to the accompanying drawings, in which.

DETAILED DESCRIPTION OF THE INVENTION

Figure 1:
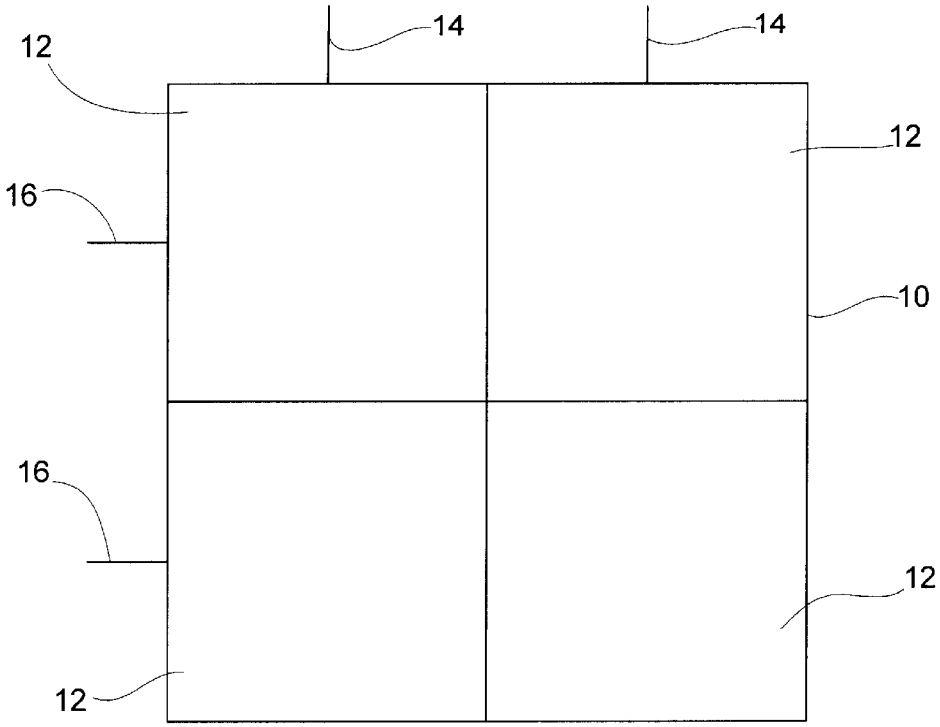
FIG. 1 shows four adjacent subpixels of equal size.

The embodiments to be described relate to bistable twisted nematic (BTN) liquid crystal displays (LCDs). Consider, for example, such a display comprising 1200×1600 pixels. It can be seen from FIG. 1 that this display can be used to display an image of 600×800 pixels if each square of 2×2 pixels is treated as a single pixel 10 comprising four subpixels 12. The four subpixels 12 are all of equal size and are driven by two column electrodes 14, and two row electrodes 16, each electrode having an associated driver (not shown). Each subpixel 12 can be either "ON" (light) or "OFF" (dark). The subpixels 12 therefore allow the single pixel 10 to display 5 different grey levels. These grey levels correspond to having 0, 1, 2, 3 or 4 subpixels 12 in the "ON" state. However, there is redundancy in such an arrangement because different combinations of subpixels 12 in the "ON" state can result in the same grey level. For example, there are four possible ways of having one subpixel 12 in the "ON" state.

However, the 1200×1600 display can still be used to display an image of 1200×1600 pixel if required by treating each subpixel 12 as a single pixel having no intermediate grey levels. The display is thus capable of providing two different screen resolutions.

Figure 2:
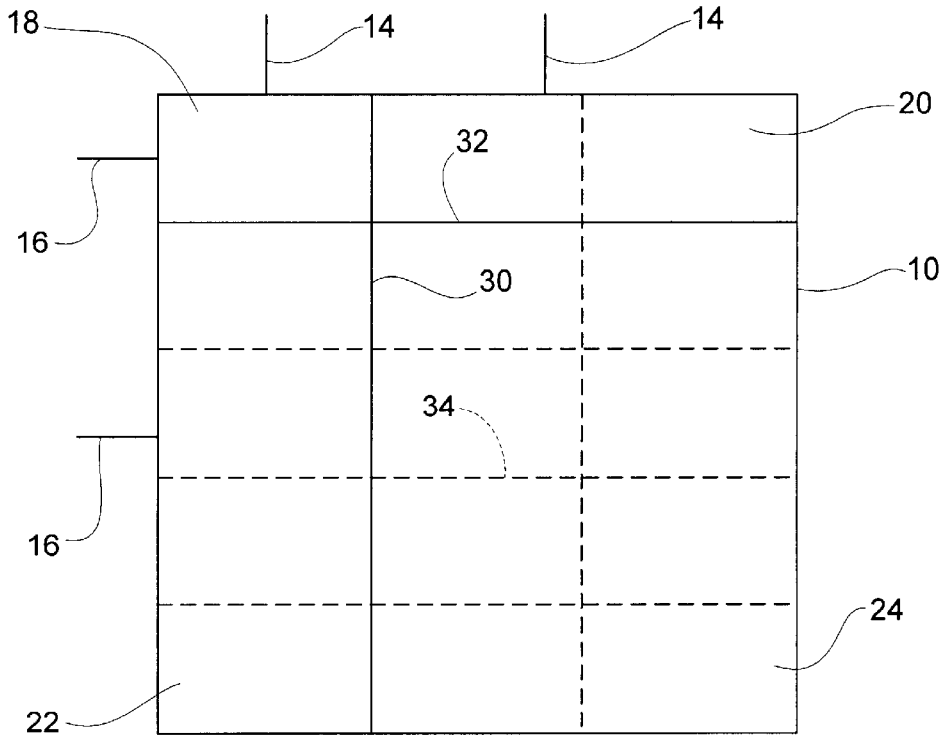
FIG. 2 shows four adjacent subpixels of differing sizes.

FIG. 2 shows that the redundancy of FIG. 1 can be removed by creating four subpixels 18, 20, 22 and 24 of different sizes. If the original pixel 10 is considered as being divided vertically by a vertical line 30 in the ratio of 1:2, and horizontally by a horizontal line 32 in the ratio of 1:4, then the first subpixel 18 represents 1/15 of the total area of the pixel 10, the second subpixel 20 2/15 of the area, the third subpixel 22 4/15 of the area, and the fourth subpixel 24 8/15 of the area. In order to show this more clearly, imaginary dotted lines 34 have been drawn on the pixel 10. When the pixel 10 is divided in this way it is possible to achieve 16 different, evenly spaced, grey levels by selecting different combinations of the subpixels 18, 20, 22 and 24.

The display can then be used to display an image of 600×800 pixels, with 16 grey levels for each pixel. However, the display can no longer be used to display an image of 1200×1600 pixels.

Figure 3:
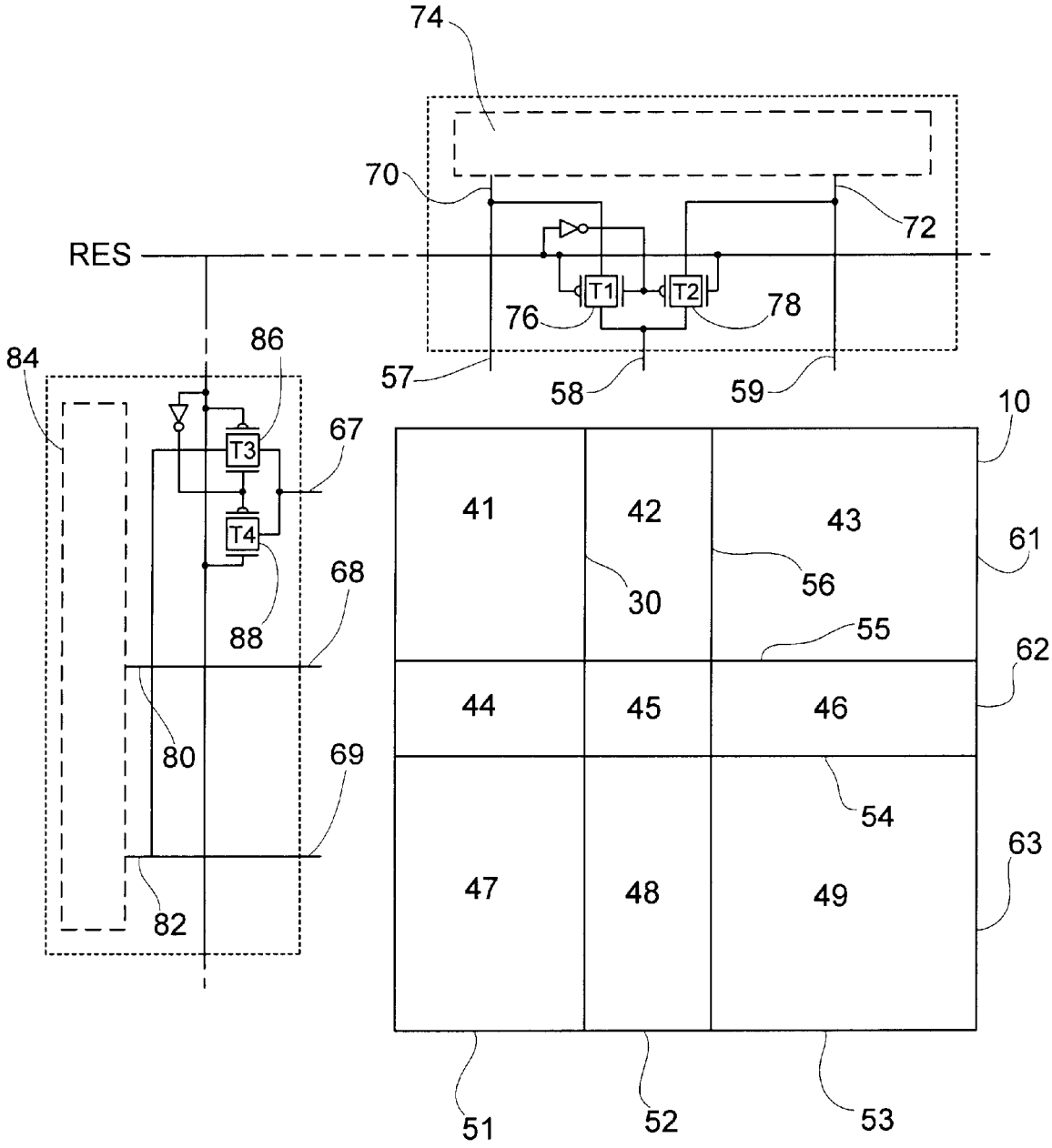
FIG. 3 shows an embodiment of the invention, incorporating nine adjacent subpixels of different sizes.

FIG. 3 shows how this problem can be overcome, while at the same time continuing to use only two column drivers and two row drivers for each pixel 10. In FIG. 3 the original pixel 10 is divided into 9 subpixels 41 to 49, which form three columns 51, 52 and 53, and three rows 61, 62 and 63, as shown in FIG. 3.

It is helpful to visualise the layout of FIG. 3 as being produced by modifying that of FIG. 2 by carrying out the following two steps. First of all, the row formed by subpixels 18 and 20 is moved downwards until the horizontal line 32 reaches the centre of the pixel 10, and becomes the horizontal line 54 in FIG. 3. The top of this row is indicated by horizontal line 55. Then the pixel 10 is divided down its centre by vertical line 56. Vertical line 30 remains in the same place.

It will thus be seen that the three columns 51, 52 and 53 split the pixel 10 in the ratios 2:1:3, and the three rows 61, 62 and 63 split the pixel 10 in the ratios 1.5:1:2.5 or equivalently 3:2:5. Thus by driving selected rows together, and selected columns together, it is possible to produce either the ratios of FIG. 1 or the ratios of FIG. 2. In particular, the columns can be driven either in the ratio (2+1):3=1:1 (corresponding to FIG. 1) or in the ratio 2:(1+3)=1:2 (corresponding to FIG. 2). Similarly, the rows can be driven either in the ratio (3+2):5=1:1 (corresponding to FIG. 1) or in the ratio 2:(3+5)=1:4 (corresponding to FIG. 2).

Furthermore, this can be done without increasing the number of drivers. That is, it is still possible to use only two drivers for each pixel 10 provided that switches are used to connect each driver to different combinations of rows or columns. This will be explained in greater detail below.

The three columns 51, 52 and 53 are addressed by three column electrodes 57, 58 and 59 respectively, and the three rows 61, 62 and 63 are addressed by three row electrodes 67, 68 and 69 respectively. Two column drivers 70 and 72 are driven by column driving electronics 74 and two row drivers 80 and 82 are driven by row driving electronics 84. Column drivers 70 and 72 remain permanently connected to column electrodes 57 and 59 respectively, and row drivers 80 and 82 remain permanently connected to row electrodes 68 and 69 respectively.

Two column MOSFET transmission gate switches 76 and 78 are provided to connect column electrode 58 either to column driver 70 or 72 under the control of a signal labelled RES in FIG. 3. Similarly, two row MOSFET transmission gate switches 86 and 88 are provided to connect row electrode 68 to either row driver 80 or 82 under the control of the RES signal. When the RES signal is high transmission gates 76 and 88 conduct and transmission gates 78 and 86 behave as open circuits. The display then operates in high resolution mode (1200×1600 in our example) with each pixel 10 behaving as four separate pixels of equal size. When the RES signal is low, gates 78 and 86 conduct and gates 76 and 88 behave as open circuits The display then operates in low resolution mode (600×800 in our example) with each pixel providing 16 possible grey scales as in the case of FIG. 2. For clarity the circuitry for only one pixel 10 is shown in FIG. 3. The other pixels are provided with the same circuitry.

Figure 4:
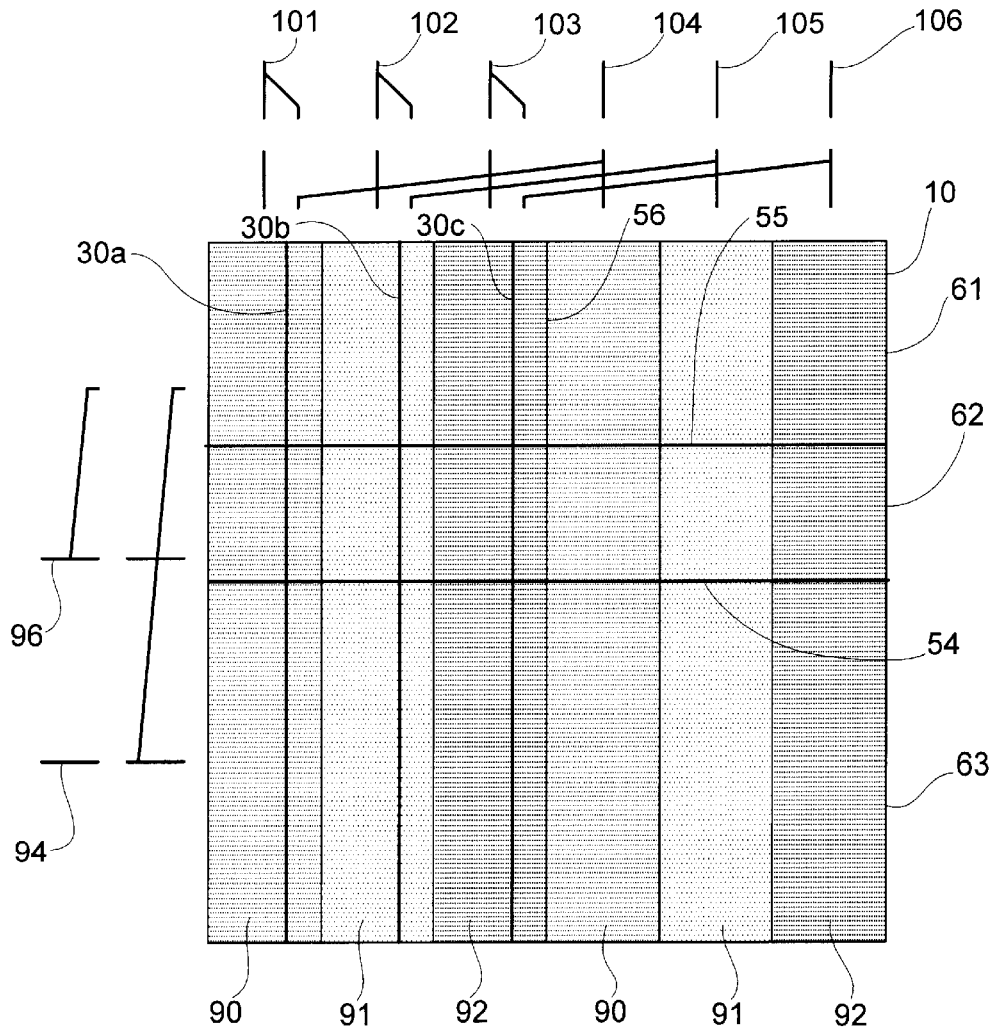
FIG. 4 is a schematic showing an extension of the embodiment of FIG. 3 incorporating subpixels of three different colours.

FIG. 4 is a schematic showing how the embodiment of FIG. 3 is extended to provide a colour display capable of operating in two different resolutions, without increasing the numder of drivers (over that needed for one resolution), while retaining the maximum number of grey scales, or colours, in the lower resolution.

As can be seen from FIG. 4, the pixel 10 is divided into 27 subpixels, which continue to form three rows 61, 62 and 63. Colour filters are placed over the pixel 10 in six vertical stripes. These form red, green and blue filters 90, 91 and 92 respectively. The pixel 10 is also divided into subpixels along the vertical lines dividing these filters. Horizontal and vertical lines 54 and 56, dividing the pixel 10 centrally, remain in the same positions, as does horizontal line 55 dividing the first and second rows 61 and 62. However, vertical line 30, which in FIG. 2 divided the pixel 10 in the ratio 1:2, is replaced by three separate vertical lines 30*a*, 30*b* and 30*c* which divide the first red, green and blue filters 90, 91 and 92 in the ratios 2:1 respectively. The effect of this can most easily be appreciated by considering each colour separately. The effect is that each colour is divided vertically in the ratios 2:1:3, which are the same ratios as used in FIG. 3.

The embodiment of FIG. 4 can be driven with only two row drivers 94 and 96, and six column drivers 101 to 106 provided suitable switching circuitry is used to connect each driver to either one or two rows or columns as indicated schematically in FIG. 4. The pixel 10 of FIG. 4 can thus be used as a single pixel (in a low resolution mode) which is capable of displaying 4096 (ie $16^3$) colours, or as four separate pixels (in a high resolution mode) each capable of displaying 8 (ie $2^3$) colours. In the latter case, each of the four pixels contains three subpixels each of a different colour, thus allowing 16 possible colours.

Figure 5:
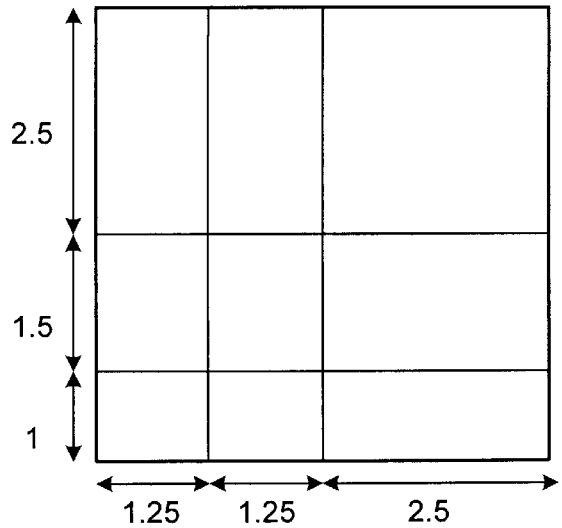
FIG. 5 shows an alternative pixel element arrangement to be used with a similar switching configuration to that used in FIG. 3.

FIG. 5 shows an alternative pixel element arrangement to be used with a similar switching configuration to that used in FIG. 3. In this case the high resolution mode is again 1:1:1:1 ratio of pixel areas, but in the low resolution mode the selected areas are in the ratio 1:3:4:12. The column electrodes are divided in the ratio 1:1.5:2.5, whilst the rows are divided in the ratio 1.25:1.25:2.5. Although these are not ideal ratios, if each of the picture element were able to show 8 linearly spaced greyleveles 0, 1, 2, 3, 4, 5, 6, 7, then in the high resolution mode the display would be a 3 bit display whilst in the low resolution mode the panel would be greater than a 7 bit display. As an example a liquid crystal display used in this way might be a diode matrix addressed liquid crystal panel.

What is claimed is:

1. A display device comprising a plurality of picture elements arranged in rows and columns, and a plurality of row and column drivers, connected to said rows and columns respectively, for driving said picture elements, wherein at least one switch is provided for switching at least one of said drivers between a first configuration in which at least a first driver drives a first row or column, and at least a second driver drives at least a second and a third row or column, and a second configuration, different from said first configuration, in which the at least first driver drives at least the first and third row or column, and the at least second driver drives the second row or column.

2. A display device as claimed in claim 1, wherein said at least one switch is a row switch which switches at least one of said row drivers between said first and second configurations, and wherein the display device also comprises at least one column switch for switching at least one of said column drivers between a third configuration in which the column driver drives at least one column, and a fourth configuration, different from said third configuration, in which the column driver drives at least two columns.

3. A display device as claimed in claim 1, wherein each picture element is switchable between only two states, said two states having different optical characteristics from each other.

4. A display device as claimed in claim 3, wherein said two states correspond to the picture element being on and off.

5. A display device as claimed in claim 1, wherein at least one picture element emits or transmits light at a different wavelength to other picture elements.

6. A display device as claimed in claim 1 wherein at least one of said picture elements emits or transmits red light, at least one of said picture elements emits or transmits green light, and at least one of said picture elements emits or transmits blue light.

7. A display device as claimed in claim 1 wherein operation of said switch or switches allows the display device to operate in at least two resolutions, including a high resolution mode and a low resolution mode.

8. A display device as claimed in claim 7, wherein the number of grey levels in the low resolution mode is higher than would be possible without said switch or switches, for a device also capable of operating in said high resolution mode.

9. A display device as claimed in claim 1, wherein said plurality of picture elements are arranged in an array of identical groups of picture elements, each group being formed by picture elements at the intersection of number of adjacent rows and columns of picture elements, and each group containing picture elements of different sizes.

10. A display device as claimed in claim 9, wherein each group of picture elements is connected to an identical switch or set of switches.

11. A display device as claimed in claim 1, which is formed from a liquid crystal panel.

12. A display device as claimed in claim 11, wherein said liquid crystal panel forms a passively addressed array.

13. A display device as claimed in claim 1, wherein said display device is a bistable mode liquid crystal display.

14. A display device as claimed in claim 1, wherein said display device is a bistable twisted nematic liquid crystal display.

15. A display device as claimed in claim 1 wherein said plurality of picture elements are arranged in an array of 9 picture elements which form three columns and three rows of picture elements, the sizes of the respective picture elements in the three columns having a ratio of 2:1:3, and the sizes of the respective picture elements in the three rows having a ratio 1.5:1:2.5.

16. A display device as claimed in claim 15, wherein the three columns are addressed by three column electrodes, respectively, and the three rows are addressed by three row electrodes respectively.

17. A display device as claimed in claim 1 wherein said plurality of picture elements are arranged in an array of 27 picture elements which form three rows and nine columns of picture elements, the sizes of the respective picture elements in the three rows having a ratio of 1.5:1:2.5, the nine columns of picture elements forming a first set of six column elements and a second set of three column elements, the sizes of the respective first and second sets having a ratio of 1:1, the sizes of the respective column elements of the first set having a ratio of 2:1:2:1:2:1, the sizes of the respective column elements of the second set having a ratio of 3:3:3, and further wherein a first set of color filters forming red, green and blue filters are placed over the first set of six column elements and a second set of color filters forming red, green and blue filters are placed over the second set of three column elements, the color filters being equally sized in a row direction and covering the array in six sequentially-aligned vertical stripes in perpendicular relation to the rows of picture elements.

18. A display device as claimed in claim 7, wherein said display device forms an actively addressed array.

19. A display device as claimed in claim 18, wherein each pixel element has at most 8 greylevels in the highest resolution mode.

20. A display device as claimed in claim 2, wherein each picture element is switchable between only two states.

21. A display device as claimed in claim 2, wherein at least one of the picture elements emits or transmits light at a different wavelength to other picture elements.

22. A display device as claimed in claim 2, wherein at least one of said picture elements emits or transmits red light, at least one of said picture elements emits or transmits green light, and at least one of said picture elements emits or transmits blue light.

23. A display device as claimed in claim 2, wherein operation of said switch or switches allows the display device to operate in at least two resolutions, including a high resolution mode and a low resolution mode.

24. A display device as claimed in claim 2, wherein said plurality of picture elements are arranged in an array of identical groups of picture elements, each group being formed by picture elements at the intersection of number of adjacent rows and columns of picture elements, and each group containing picture elements of different sizes.

25. A display device as claimed in claim 2, which is formed from a liquid crystal panel.

26. A display device as claimed in claim 2, wherein said display device is a bistable liquid crystal mode.

27. A display device as claimed in claim 2, wherein said display device is a bistable twisted nematic liquid crystal display.

28. A display device as claimed in claim 2, wherein said plurality of picture elements are arranged in an array of 9 picture elements which form three columns and three rows of picture elements, the sizes of the respective picture elements in the three columns having a ratio of 2:1:3, and the sizes of the respective picture elements in the three rows having a ratio 1.5:1:2.5.

29. A display device as claimed in claim 2, wherein said plurality of picture elements are arranged in an array of 27 picture elements which form three rows and nine columns of picture elements, the sizes of the respective picture elements in the three rows having a ratio of 1.5:1:2.5, the nine columns of picture elements forming a first set of six column elements and a second set of three column elements, the sizes of the respective first and second sets having a ratio of 1:1, the sizes of the respective column elements of the first set having a ratio of 2:1:2:1:2:1, the sizes of the respective column elements of the second set having a ratio of 3:3:3, and further wherein a first set of color filters forming red, green and blue filters are placed over the first set of six column elements and a second set of color filters forming red, green and blue filters are placed over the second set of three column elements, the color filters being equally sized in a row direction and covering the array in six sequentially-aligned vertical stripes in perpendicular relation to the rows of picture elements.

* * * * *